US006024242A

United States Patent [19]

Stevenson

[11] Patent Number: 6,024,242

[45] Date of Patent: Feb. 15, 2000

[54] REMOVABLY INSERTABLE INTERNAL CONTAINMENT RESERVOIR

[75] Inventor: Scott Jae Stevenson, Albuquerque, N.Mex.

[73] Assignee: Eidson Steel Products, Inc., Albuquerque, N.Mex.

[21] Appl. No.: 08/772,347

[22] Filed: Dec. 24, 1996

[51] Int. Cl.[7] ..... B65D 90/10

[52] U.S. Cl. ..... 220/567.1; 220/560.03; 220/567.2; 220/501; 220/4.12

[58] Field of Search ..... 220/565, 4.12, 220/23.83, 23.86, 469, 468, 467, 571, 567, 567.1, 567.2, 560.1, 560.03, 529, 501, 23.89, 23.87, 23.9; 137/15, 312; 141/86

[56] References Cited

U.S. PATENT DOCUMENTS

| | | | |
|---|---|---|---|
| 4,305,416 | 12/1981 | Henning et al. | 220/501 |
| 4,501,305 | 2/1985 | Zola et al. | 141/86 |
| 4,552,166 | 11/1985 | Chadbourne, Sr. et al. | 220/567.1 |
| 4,659,251 | 4/1987 | Petter et al. | 405/52 |
| 4,685,585 | 8/1987 | Robbins | 220/256 |
| 4,762,440 | 8/1988 | Argandona | 405/52 |
| 4,763,806 | 8/1988 | Podgers et al. | 220/86 |
| 4,770,317 | 9/1988 | Podgers et al. | 141/86 |
| 4,815,621 | 3/1989 | Bartis | 220/565 |
| 4,896,705 | 1/1990 | Podgers et al. | 137/312 |
| 4,912,966 | 4/1990 | Sharp | 220/567.2 |
| 4,958,957 | 9/1990 | Berg et al. | 220/567.2 |
| 4,986,436 | 1/1991 | Bambacigno et al. | 220/86 |
| 4,989,634 | 2/1991 | Rieseck | 137/312 |
| 5,056,680 | 10/1991 | Sharp | 220/465 |
| 5,085,257 | 2/1992 | Smith | 141/86 |
| 5,251,473 | 10/1993 | Reese | 220/565 |
| 5,269,436 | 12/1993 | Bachmann | 220/565 |
| 5,381,923 | 1/1995 | O'Dea | 220/565 |
| 5,495,695 | 3/1996 | Elliott, Jr. | 52/20 |
| 5,501,243 | 3/1996 | Palazzo | 137/312 |
| 5,505,327 | 4/1996 | Witt | 220/495.06 |
| 5,564,588 | 10/1996 | Reese | 220/565 |
| 5,570,714 | 11/1996 | Magish | 137/312 |
| 5,829,265 | 11/1998 | Lord et al. | 137/312 |

*Primary Examiner*—Stephen Castellano
*Attorney, Agent, or Firm*—Ray R. Regan

[57] ABSTRACT

A removably insertable internal containment reservoir for a storage tank includes a container having an outside surface and an inside surface and formed with a chamber. The chamber has an open distal end and a closed proximal end. The closed proximal end is formed with one or more holes for providing access to the interior of the storage tank. A collar is peripherally attached to the outside surface of the container. The collar is engageable with a flange installed on a manhole assembly of a storage tank. The collar is located a known distance below the distal end of the chamber to position the proximal end of the chamber a second distance within the storage tank. Means are provided for closing the open distal end of the container. Means also are provided for installing in one or more of the holes formed in the closed proximal end of the container a variety of devices depending on what is stored in the storage tank.

12 Claims, 2 Drawing Sheets

REMOVABLY INSERTABLE INTERNAL CONTAINMENT RESERVOIR

CROSS-REFERENCE TO RELATED APPLICATION

None.

FEDERALLY SPONSORED RESEARCH AND DEVELOPMENT

None.

FIELD OF THE INVENTION

The present invention pertains generally to above ground and below ground storage tanks for a variety of liquids and chemicals. More particularly, the present invention pertains to an internal containment reservoir removably insertable into a storage tank. The present invention is particularly, but not exclusively, useful for retrofitting storage tanks having a manhole assembly with an internal containment reservoir.

BACKGROUND OF THE INVENTION

Storage tanks and storage systems are manufactured and used to contain and isolate a wide variety of liquids, solids and chemicals. Storage tanks and storage systems also are used to prevent leakage of the contents of storage tanks ("stored materials") into the environment. The term "environment" includes, but is not limited to, the physical and chemical surroundings of the stored materials. Thus, storage tanks are used to prevent leakage of the stored materials into the immediate surroundings including, but not limited to, earth, water and air. Storage tanks also are used to prevent leakage of stored materials and materials about to be stored in storage tanks (collectively, "contents of storage tanks") into the self-same contents of storage tanks. Spillage or leakage of contents of storage tanks may occur during filling and removing the contents of storage tanks. Several varieties of storage tanks are deployed nationally and internationally, both above and below ground, for storage of stored materials.

Most storage tanks share a common structure and cooperation of structure for filling the storage tanks with stored materials, and for removing the contents of storage tanks from storage tanks. The commonality of structure includes, but is not limited to, a storage tank having an orifice for filling the storage tank with stored materials and for removing stored materials from the tank. In many conventional storage tanks, the orifice for filling and removing the contents of storage tanks is housed in an overfill reservoir which is permanently installed in the storage tank, frequently within a permanently installed manhole of the storage tank. Overfill reservoirs also are known as piping reservoirs, seepage accumulators, catchment basins, sumps and containment vessels (collectively, "reservoir" or "reservoirs"). Piping is connectable to an apparatus installed in the orifice to fill the storage tank or remove stored materials from the storage tank. The overfill reservoir may be designed to accumulate spillage and overfill of the contents of storage tanks which may occur during filling or removing the contents of storage tanks. While many reservoirs are permanently installed in storage tanks, some reservoirs are located adjacent to storage tanks. Reservoirs that are permanently installed in a storage tank usually are located near the gravitational top of the storage tank, and may be accessed through hinged lids installed on manhole assemblies in which reservoirs are located. Any number of additional devices may be included in, or added to, overfill reservoirs for communication between the storage tank and the manhole assembly, including, but not limited to, devices for venting, heating stored materials (such as diesel fuel), varying the size of the orifice through which the storage tank is filled with stored materials, preventing siphoning, venting, leaking, and other accouterment associated with the composition of the particular stored materials.

Additionally, the contents of storage tanks may be deemed hazardous or toxic. The structure and cooperation of structure of storage tanks, any manhole assemblies installed on storage tanks, and containment reservoirs designed in connection with hazardous and toxic materials, or in which the contents of storage tanks are required to be maintained in a pure, isolated, or pristine state, may be subject to standards and codes in the United States promulgated by state and federal agencies, or promulgated by independent agencies and associations such as Underwriters Laboratories ("UL"), American Petroleum Institute ("API"), American National Standards Institute ("ANSI"), American Water Works Association ("AWWA"), and the American Society of Mechanical Engineers ("ASME") (collectively, but not exclusively, "Standards Agencies"). Standards and codes published by Standards Agencies ("Standards") exist in countries other than the United States, and it is likely that more nations will impose standards and codes as concerns grow about toxicity, handling hazardous materials, and the effect on the environment and on people of mishandling hazardous and toxic stored materials.

To achieve the express and implicit requirements of one or more of the current Standards, particularly those in connection with toxic or hazardous stored materials, it is useful if overfill reservoirs extend a predetermined distance below the innermost internal wall of storage tanks. The purpose of locating the overfill reservoir below the innermost internal wall of storage tanks is to provide additional insulating and isolating protection within the confines of the storage tank of the overspilled contents of storage tanks, a result often referred to as "internal containment." In part to achieve internal containment of overspilled contents of storage tanks in containment reservoirs, storage tanks have been designed with at least one inner wall, and often more than one inner wall, the latter storage tank often described as a "double wall" storage tank. In addition, secondary containment of spillage is achieved by designing piping connections which contribute to secondary internal confinement.

To the extent that internal containment reservoirs are not permanently installed components of a storage tank, manufacturers of storage tanks may be required to conduct special independent testing, or obtain special certification, from one or more of the Standards Agencies that the overfill containment reservoir satisfies certain standards, or the demands of users of storage tanks. The industry objective of users of storage tanks is for tanks which provide as much secondary containment as possible, not only to satisfy Standards Agencies, but also to reduce the possibility of contamination to the environment due to spillage of the contents of storage tanks. In addition, the Standards do not permit a storage tank already deployed in field use to be retrofitted with an internal containment reservoir without violating prior certification of construction compliance with the construction standards of the Standards Agencies.

The present invention relates to an apparatus and method which is useful in retrofitting existing storage tanks, particularly storage tanks already field deployed, with an internal containment reservoir which can be both installed in the field and removed in the field. The present invention also relates to an internal containment reservoir which provides the advantages of secondary containment of stored materials due to spillage. In addition, the present invention relates to a removably insertable internal containment apparatus which provides for the spillage protection comparable to double wall storage tanks themselves, and which meets the express, implicit and likely future Standards of the Standards Agencies. Currently, there is no known device which meets the standards and codes of the Standards Agencies for an overfill containment reservoir which permits field retrofitting of existing and already field deployed storage tanks with an internal containment reservoir.

What is needed, therefore, is a removably insertable containment reservoir which, following installation in a storage tank manhole assembly, is located within the storage tank in such a manner as to satisfy the demands of users of storage tanks for an internal containment reservoir which provides for the spillage protection comparable to double wall storage tanks themselves. What also is needed is a removably insertable internal containment reservoir which meets the express, implicit and likely future Standards of the Standards Agencies for internal containment of spillage.

In light of the above, it is an object of the present invention to provide an apparatus, and method of manufacturing and installation in a storage tank, for an removably insertable containment reservoir which, following installation in a storage tank manhole assembly, is located within the storage tank in such a manner as to provide internal containment of spillage.

It is another object of the present invention to provide a removably insertable internal containment reservoir which provides for the spillage protection comparable to double wall storage tanks themselves.

It is yet another object of the present invention to satisfy the express, implicit and likely future Standards of the Standards Agencies.

It is another object of the present invention to provide a removably insertable internal containment reservoir which is easily retrofitable in connection with existing field deployed storage tanks.

Yet another object of the present invention is to provide a removably insertable internal containment reservoir, and a method for manufacturing a removably insertable internal containment reservoir, which respectively are easy to use and to practice, and which are cost effective for their intended purposes.

These and other objects, features, and advantages of such a removably insertable internal containment reservoir will become apparent to those skilled in the art when read in conjunction with the accompanying following detailed description, drawing figures, and appended claims.

SUMMARY OF THE INVENTION

A removably insertable internal containment reservoir for a storage tank, according to the present invention, includes a container having an outside surface and an inside surface. The outside surface and the inside surface of the container form a chamber. The chamber of the container has an open distal end and a closed proximal end. The outside surface of the container is dimensioned and shaped to be engageable with the internal surface and periphery of a manhole assembly of a storage tank for those storage tanks equipped with a manhole assembly. Accordingly, the shape of the container may be tubular, cylindrical, or any other configuration necessary to allow the container to be engageable with and removable from the internal surface of a manhole assembly of a storage tank.

The closed proximal end of the chamber is formed with at least one hole. When installed within a manhole assembly of a storage tank, one or more of the holes formed in the closed proximal end of the container may provide fluid, gas or solid communication to the interior of the storage tank. Materials stored in the storage tank may include, but are not limited to, water, gases, gasoline and other associated petroleum products, fluids, powders, and a wide variety of liquids and chemicals.

Any number of mechanical, electronic, electrical and other devices well known in the art may be inserted into one or more holes formed in the closed proximal end of the container to permit a user to fill the storage tank, and to remove stored materials from the storage tank. For example, a pipe nipple may be engaged with a hole formed in the closed proximal end of the container. A hose or other piping may be temporarily secured to the pipe nipple for injecting material into a storage tank, and withdrawing the contents of the storage tank from the storage tank. However, as will be evident to a person well skilled in the art, a nipple is but one of any number of devices which may be engaged with a hole formed in the closed proximal end of the container for injecting stored material into, and withdrawing stored material from, the interior of the storage tank. Further, additional holes may be formed in the closed proximal end of the container to serve any number of purposes, depending on the nature of the materials to be stored in the storage tank. For example, devices may be installed in the holes formed in the proximal closed end of the container in connection with stored materials for venting gases from the interior of the storage tank, for maintaining a prescribed temperature or temperature range of the stored materials (such as storage of diesel fuel which may coagulate below certain temperatures), for providing anti-siphoning valves to prevent leaking, and for providing needs associated with a particularized material being stored in the tank.

A removably insertable internal containment reservoir for a storage tank, according to the present invention, may also include a collar peripherally attached to the outside surface of the container. The collar is formed and dimensioned to be engageable with a flange which may be attached to, or formed in, the external surface of a manhole assembly installed in a storage tank. As will be evident to one skilled in the art, the shape and configuration of the collar is a function of the shape and configuration of a flange attached to or formed in the external surface of a manhole assembly installed in a storage tank. On installation of the removably insertable internal containment reservoir according to the present invention into the manhole assembly of a storage tank, the collar peripherally attached to the outside surface of the container may be attached to the flange attached to or formed in the external surface of a manhole assembly installed in a storage tank by any number of a variety of attachment means and devices. For example, and not by way of limitation, a flange attached to or formed in the external surface of a manhole assembly may be provided with bolt bores. Bolt bores of a similar size and configuration may be provided for in the collar which is attached to the outside surface of the container, and the removably insertable internal containment reservoir according to the present invention may be engaged with the flange by use of bolts, washers and nuts. As will be obvious to one skilled in the art, the removably insertable internal containment reservoir, according to the present invention, may be attached within a manhole assembly of a storage tank although the manhole assembly may not provide a flange to which a collar attached to the reservoir can be affixed. For example, but not by way of limitation, the reservoir could be attached by a spacer system well known in the art, the spacer system installed between the outer surface of the container of the reservoir, and the surface of the manhole assembly facing the outside surface of the container of the reservoir when the reservoir is installed within the manhole assembly.

As will be evident to one skilled in the art, a singular advantage of the removably insertable internal containment reservoir according to the present invention is the fact that the reservoir not only may be attached to and integrated with a storage tank, whether or not equipped with a manhole assembly, but may also be removed for any number of reasons such as redesign of the removably insertable internal containment reservoir, cleaning the reservoir, conducting safety inspections or corrosion inspections, or any other of a variety of reasons.

The collar peripherally attached to the outside surface of the container of the removably insertable internal containment reservoir, according to the present invention, also is attached to the outside surface of the container so as to position the closed proximal end of the container a predetermined distance into and within the storage tank to achieve secondary or internal containment of any spilled materials within the reservoir ("internal containment"). In part to achieve internal containment of spilled materials in containment reservoirs, some storage tanks are manufactured with more than one full or partial additional tank walls. Such tanks generally are described as "double wall" tanks, although a storage tank may also be equipped with more than two inner walls. In addition, internal containment of spillage is achieved by designing piping connections which contribute to internal confinement of spillage. As will be clear to one skilled in the art, the present invention thus provides for spillage protection comparable to double wall storage tanks themselves. The ability of the present invention to provide internal containment also complies with, and anticipates, express, implicit and likely future Standards of the Standards Agencies.

The container of the removably insertable internal containment reservoir according to the present invention also provides means for closing the open distal end of the container. For example, and not by way of limitation, a hinged lid may be installed adjacent to the open distal end of the container, allowing a user to access the interior of the container, and to seal the open distal end of the container by engaging the hinged lid with the top edge of the container. As will be evident to those skilled in the art, any number of a variety of devices may be used to close and seal the open distal end of the container.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF THE PREFERRED EMBODIMENTS

Figure 1:
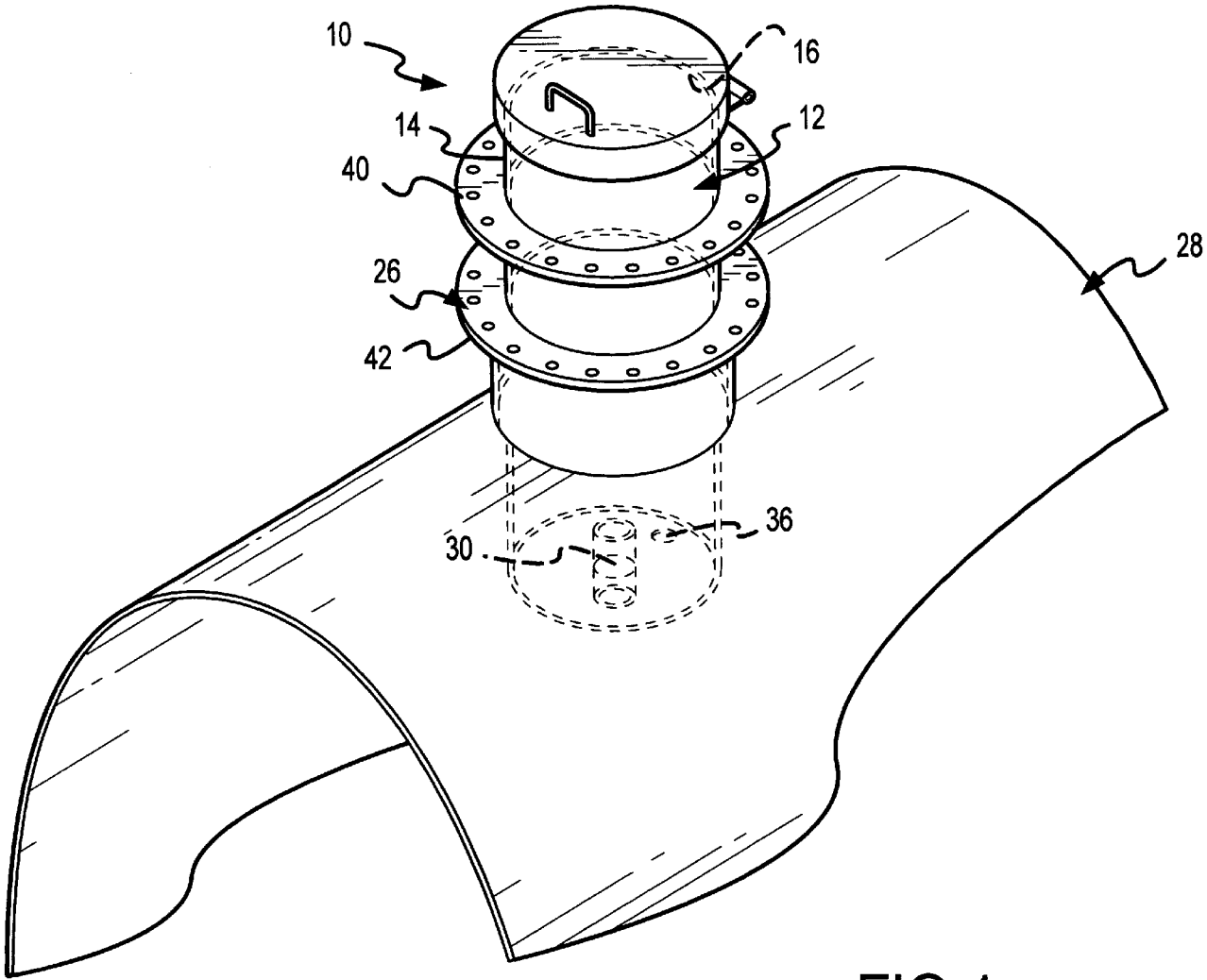
FIG. 1 is a perspective view of the removably insertable internal containment reservoir, according to the present invention, in relationship with a manhole assembly of a partially provided storage tank.

Referring initially to FIGS. 1, the removably insertable internal containment reservoir according to the present invention is shown and generally designated 10. As shown perhaps most clearly in FIG. 2, removably insertable internal containment reservoir 10 according to the present invention includes a container 12 having an outside surface 14 and an inside surface 16. As shown by cross-reference between FIGS. 1 and 2, outside surface 14 and inside surface 16 form a chamber 18. Chamber 18 of container 12 has an open distal end 20 and a closed proximal end 22. Outside surface 14 of container 12 is dimensioned and shaped to be slidingly engageable with the internal surface 24 of a manhole assembly 26 of a storage tank 28. Accordingly, while FIGS. 1 and 2 depict substantially tubular and cylindrical examples of both container 12 and of manhole assembly 26, the shape of container 12 may be any configuration necessary to allow container 12 to be slidingly engageable with internal surface 24 of manhole assembly 26.

Figure 2:
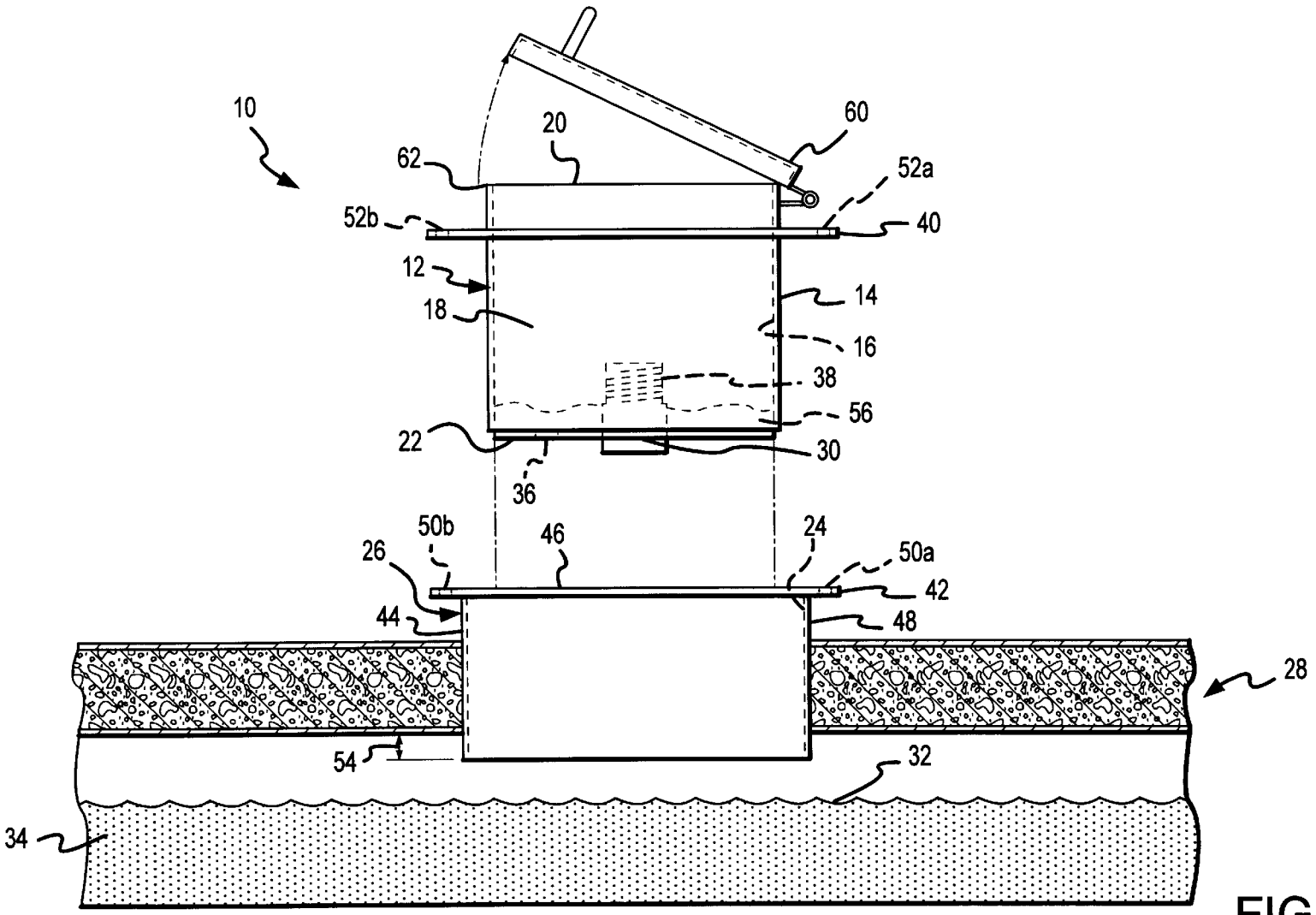
FIG. 2 is a side cross-sectional view of the removably insertable internal containment reservoir in association with a partial cross-sectional view of a storage tank which is provided with a manhole assembly.

Further referring by cross-reference between FIGS. 1 and 2, closed proximal end 22 of chamber 12 is formed with at least one hole 30. When installed within manhole assembly 26 of storage tank 28, hole 30 formed in closed proximal end 22 of container 12 may provide fluid, gas, solid and other communication to the interior 32 of storage tank 28. Materials 34 stored in storage tank 28 may include, but are not limited to, water, gasoline and other associated petroleum products, fluids, powders, and a wide variety of liquids and chemicals. Any number of mechanical devices well known in the art may be inserted into one or more additional holes (one is shown in FIG. 2) 36 formed in closed proximal end 22 of container 12 to permit a user to inject stored materials 34 into, and withdraw stored materials 34 from, storage tank 28, to maintain temperatures or temperature ranges within storage tank 28 and stored materials 34, and to otherwise monitor and control stored materials 34. For example, as shown in FIG. 2, a pipe nipple 38 may be threadably engaged into hole 30 formed in closed proximal end 22 of container to 12 which may be removably secured to piping (not shown) for injecting stored material 34 into, and withdrawing stored material 34 from, interior 32 of storage tank 28. However, as will be evident to a person skilled in the art, nipple 38 is but one of any number of devices which may be engaged with one or more additional holes 36, and hole 30, formed in closed proximal end 22 of container 12 for injecting stored material 34 into, and withdrawing stored material 34 from, interior 32 of storage tank 28. One or more additional holes 36 may be formed in closed proximal end 22 of container 12 to serve any number of purposes. The purposes for one or more additional holes 36 may be a function of the chemical composition, toxicity, and other parameters of stored materials 34. For example, devices (not shown) may be installed in one or more additional holes 36 formed in proximal closed end 22 of container 12 for venting gases from interior 32 of storage tank 28, maintaining a prescribed temperature or temperature range of stored materials 34 (such as storage of diesel fuel which may coagulate below certain temperatures), providing anti-siphoning valves to prevent leaking of stored materials 34, and providing other apparatus for monitoring and controlling stored materials 34.

As shown in FIG. 2, removably insertable internal containment reservoir 10 according to the present invention also includes a collar 40 peripherally attached to outside surface 14 of container 12. Collar 40 may be attached to outside surface 14 of container 12 in any number of a variety of ways including, but not limited to, welding. Collar 40 is formed and dimensioned to be engageable with a flange 42 on manhole assembly 26. Storage tank 28 provides a conventional manhole assembly 26 having an external surface 44 and an internal surface 24 forming a manhole lumen 46. Lumen 46 may be open at both ends of lumen 46. External surface 44 and internal surface 24 of manhole assembly 26 form a distal edge 48 of lumen 46 as shown in FIG. 2. Flange 42 is attached to, or formed in, external surface 44 of manhole assembly 26 near or at distal edge 48 formed in lumen 46. Also, a device for controlling spillage within storage tank 28 is permanently and immovably attached within manhole assembly 26 to control overfill spillage of stored materials. As will be evident to one skilled in the art, the shape and configuration of collar 40 is a function of the shape and configuration of flange 42 attached to or formed in external surface 44 of manhole assembly 26 installed in storage tank 28. On installation of the removably insertable internal containment reservoir 10, according to the present invention, into manhole assembly 26 of storage tank 28, as shown in FIG. 2, collar 40 peripherally attached to outside surface 14 of container 12 may be attached to flange 42 attached to or formed in external surface 44 of manhole assembly 26 installed in storage tank 28 by any number of a variety of attachment means and devices. For example, and not by way of limitation, flange 42 attached to or formed in external surface 44 of manhole assembly 26 is shown in FIG. 2 as provided with bolt bores 50*a, b*. Matching bolt bores 52*a, b* having a similar size and configuration as bolt bores 52*a, b* may be provided for in collar 40, and removably insertable internal containment reservoir 10 according to the present invention may be engaged with flange 42 by use of bolts, washers and nuts (not shown).

As will be evident to one skilled in the art, a singular advantage of removably insertable internal containment reservoir 10, according to the present invention, is the fact that reservoir 10 not only may be attached to and integrated with manhole assembly 26 of storage tank 28, but also may be removed from installation with storage tank 28 for any number of reasons such as redesign of reservoir 10, cleaning reservoir 10, or any other of a variety of reasons.

As shown in FIG. 2, collar 40 peripherally attached to outside surface 14 of container 12 of removably insertable internal containment reservoir 10, according to the present invention, also is attached to outside surface 14 of container 12 so as to position closed proximal end 22 of container 12 a predetermined distance ("di") 54 within storage tank 28 to provide containment of spillage 56. Predetermined distance "di" 54 provides for containing spillage 56 within tank 28, and thus provides an overfill reservoir extending predetermined distance "di" 54 below the innermost internal wall 58 of storage tank 28 to provide additional insulating and isolating protection within the confines of storage tank 28 for spillage 56.

Container 12 of removably insertable internal containment reservoir 10, according to the present invention, also provides for an apparatus, such as a hinged lid 60, for closing open distal end 20 of container 12. For example, and not by way of limitation, hinged lid 60 may be installed adjacent to open distal end 20 of container 12, allowing a user to access interior 32 of chamber 18 for any reason, and to seal open distal end 20 of container 12 by engaging hinged lid 60 with the top edge 62 of container 12. As will be evident to those skilled in the art, any number of a variety of devices may be used to close and seal open distal end 20 of container 12.

While the particular removably insertable internal containment reservoir according to the present invention as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

What is claimed is:

1. A containment reservoir removably insertable into a storage tank having at least one inner wall, comprising:

a container having an outside surface and an inside surface and formed with a chamber, said chamber having an open distal end and a closed proximal end, said proximal end formed with at least one hole for communication between said container and said storage tank;

means for attaching said container to said tank;

means for positioning said closed proximal end of said container a known distance below said inner wall of said storage tank;

means attachable to said open distal end of said container for closing said open distal end of said chamber; and means insertable into said at least one said hole in said closed proximal end of said container for controlling communication between said container and said storage tank wherein said means for controlling communication between said container and said storage tank is a threaded pipe nipple.

2. A containment reservoir removably insertable into a storage tank having at least one inner wall as recited in claim 1, wherein said tank is adapted to include a manhole assembly, said manhole assembly having an external surface and an internal surface, having a flange formed on said external surface of said manhole assembly.

3. A containment reservoir removably insertable into a storage tank having at least one inner wall as recited in claim 2, wherein said container further comprises a collar peripherally attached to said outside surface of said container, said collar having a top plane and a bottom plane and forming an edge between said top plane and said bottom plane, said collar further formed with at least one bore through said top plane and said bottom plane of said collar.

4. A containment reservoir removably insertable into a storage tank having at least one inner wall as recited in claim 3, wherein said attaching means is a bolt insertable through said at least one bore for attaching said collar to the flange of said manhole assembly.

5. A containment reservoir as recited in claim 1, wherein said closing means is a hinged lid.

6. A containment reservoir removably insertable into a manhole assembly of a storage tank, comprising:

a container formed with a chamber having an outside surface and an inside surface, said chamber having an open distal end and a closed proximal end, said proximal end formed with at least one hole for communication between said container and said storage tank;

a collar peripherally attached to said outside surface of said container, said collar engageable with said manhole assembly;

means attachable to said open distal end of said container for closing said open distal end of said chamber; and means insertable into said at least one said hole in said closed proximal end of said container for controlling communication between said container and said tank wherein said means for controlling communication between said container and said tank is a threaded pipe nipple.

7. A containment reservoir as recited in claim 6, wherein said collar is attached to said outside surface of said container to position said closed proximal end of said chamber a predetermined distance within said storage tank.

8. A containment reservoir as recited in claim 6, wherein said container is adapted to extend a known distance into said storage tank.

9. A containment reservoir insertable into a manhole assembly of a storage tank as recited in claim 6, wherein said container is adapted to extend a predetermined distance into said storage tank and below an inner wall of said storage tank.

10. A containment reservoir as recited in claim 6, wherein said at least one hole is further formed for installing means for venting gas from within said storage tank through said open distal end of said container.

11. A containment reservoir as recited in claim 6, wherein said at least one hole is formed for installing an anti-siphoning valve for further controlling leakage of materials stored in said storage tank.

12. A containment reservoir as recited in claim 6 wherein said closing means is a hinged lid.

* * * * *